United States Patent [19]

Rohr

[11] Patent Number: 4,744,319

[45] Date of Patent: May 17, 1988

[54] WORKPIECE CONTROLLING DEVICE FOR A SEWING MACHINE

[75] Inventor: Gunter Rohr, Hemmingen, Fed. Rep. of Germany

[73] Assignee: Union Special GmbH, Stuttgart, Fed. Rep. of Germany

[21] Appl. No.: 62,630

[22] Filed: Jun. 16, 1987

[30] Foreign Application Priority Data

Jun. 25, 1986 [DE] Fed. Rep. of Germany ..... 3621238

[51] Int. Cl.[4] ..... D05B 27/00

[52] U.S. Cl. ..... 112/306; 112/308

[58] Field of Search ..... 112/306, 308, 309, 312, 112/313

[56] References Cited

U.S. PATENT DOCUMENTS

| | | | |
|---|---|---|---|
| 1,943,301 | 1/1934 | De Voe | 112/309 |
| 2,731,929 | 1/1956 | Ayres | 112/309 |
| 3,004,503 | 10/1961 | Erlichman | 112/309 |
| 4,187,794 | 2/1980 | Ross et al. | 112/308 |
| 4,589,364 | 5/1980 | Yamamoto | 112/313 X |

*Primary Examiner*—Ronald Feldbaum

*Attorney, Agent, or Firm*—Powell L. Sprunger

[57] ABSTRACT

A workpiece controlling device for a sewing machine comprising, a workpiece feed mechanism which feeds material in a substantially straight line, an alignment device disposed immediately in advance of the point of stitch formation in the region of a needle plate, a device for moving the alignment device transversely relative to the direction of material feed in the sewing machine, with the alignment device acting on the workpiece in synchronism with the stitch formation, and a device for controlling the transverse motion of the alignment device.

24 Claims, 1 Drawing Sheet

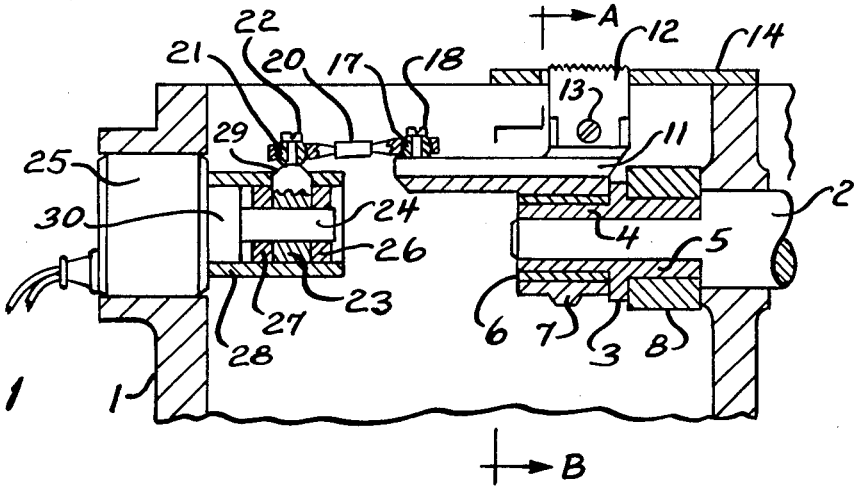
FIG. 1
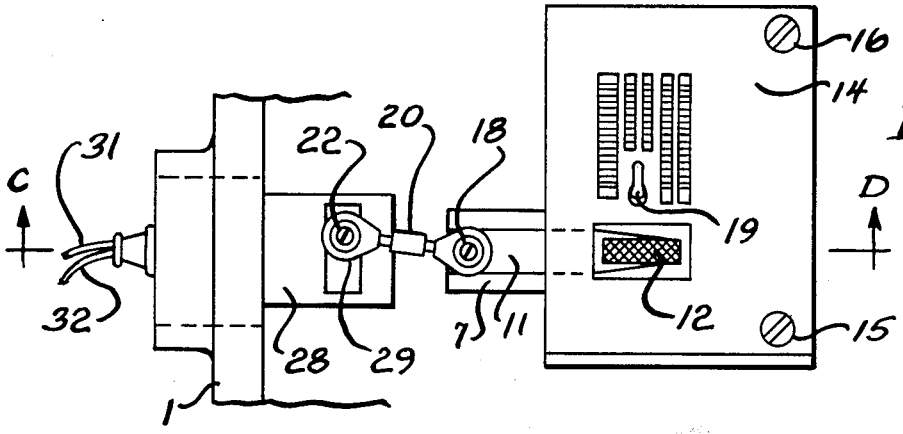
FIG. 2
FIG. 3
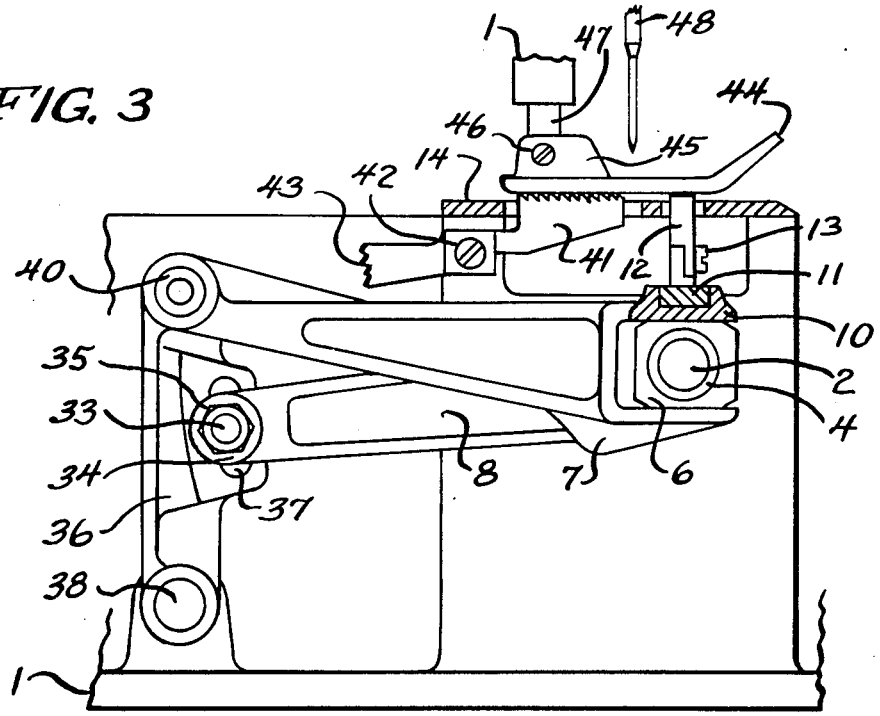

WORKPIECE CONTROLLING DEVICE FOR A SEWING MACHINE

BACKGROUND OF THE INVENTION

The present invention relates to workpiece controlling devices for sewing machines having a workpiece feed mechanism adapted to feed material in a substantially straight line.

Automatic workpiece alignment devices having controlled alignment means which can move transversely of the direction of feed of the material are described, for example, in German patent specification No. 29 48 498. The alignment means of this device is, however, outside the sewing machine and is disposed far from the point of stitch formation of the sewing machine in a tensioning device, and moves continuously in the direction of feed of the material, although the feed of material in the sewing machine takes place intermittently. Although this results in an intensive displacement of the edge of an opening of a tubular workpiece transversely of the direction of sewing, it is not suitable for controlling and aligning finite flat workpieces, and, because of the large number of alignment elements, it is an expensive construction.

SUMMARY OF THE INVENTION

A principal feature of the present invention is the provision of an improved workpiece controlling device for a sewing machine.

The controlling device of the present invention comprises, a workpiece feed mechanism which feeds material in a substantially straight line, alignment means disposed immediately in advance of the point of stitch formation in the region of a needle plate, means for moving the alignment means transversely relative to the direction of material feed in the sewing machine, with the alignment means acting on the workpiece in synchronism with the stitch formation, and means for controlling the transverse motion of the alignment means.

A feature of the invention is that the alignment function of the alignment means is simplified.

Another feature of the invention is that the workpiece is aligned accurately, particularly where the edge of the workpiece is wavy rather than straight.

Yet another feature of the invention is that it is possible to intensively displace the workpiece transversely of the direction of material feed immediately in advance of the stitch formation point, which results in precise alignment of the workpiece.

A further feature of the invention is that the alignment means is moved in the direction of material feed in synchronism with the stitch formation, and there is thus no puckering of the workpiece in the direction of material feed.

Further features will become more fully apparent in the following description of the embodiments of this invention and from the appended claims.

DESCRIPTION OF THE DRAWINGS

In the drawings:

FIG. 1 in a sectional view of a workpiece controlling device taken substantially as indicated along the line C-D of FIG. 2;

FIG. 2 is a plan view of the workpiece controlling device; and

FIG. 3 is a sectional view taken substantially as indicated along the line A-B of FIG. 1.

DESCRIPTION OF THE PREFERRED EMBODIMENTS

Referring now to FIGS. 1–3, a workpiece controlling device is shown disposed in a sewing machine housing 1, and is driven by a shaft 2. An eccentric element 3 is disposed on the shaft 2, and has a lifting eccentric 4 and a travel eccentric 5. The lifting eccentric 4 is enclosed by a sliding block 6 which is mounted in a carrier 7. The travel eccentric 5 is enclosed by a connecting rod 8.

A carriage 11, which carries a corrector 12, moves in a carriage guide 10 which is disposed on the carrier 7. The corrector 12 is secured to the carriage 11 by means of a screw 13. The corrector 12 projects through a needle plate 14, which is secured to the housing 1 by screws 15, 16. The needle plate 14 contains a needle hole 19. A hollow sphere 17 is fastened to the free end of the carriage 11 by means of a screw 18.

One end of a connecting rod 20 encloses the hollow sphere 17, and the other end encloses a hollow sphere 21 which is secured by means of a screw 22 to an adjustable pivot point 29 of a split lever 23. The lever 23 is mounted on a swivel shaft 24 which protrudes from an adjusting device 25. The swivel shaft 24 is mounted in two bushes 26 and 27, which are in turn disposed in a slotted bush 28. The bush 28 is connected to a journal 30 of the adjusting device 25. Two leads 31 and 32 connect the adjusting device 25 to a control command device which is not shown in the drawings.

The connecting rod 8 is articulated to a frame 36 by way of a flange bolt 33, a washer 34 and a nut 35. The frame 36 contains a slotted hole 37, through which the flange bolt 33 projects. A shaft 38, which is fixed to the housing, articulates the frame 36 to the housing 1. The free end of the frame 36 is articulated to the arrie 7 by way of a hollow shaft 40.

A feed dog 41 projects through the needle plate 14, and is secured to a feed dog carrier 43 by means of a screw 42. The corrector 12 lies opposite a foot 44, which is connected to a boss 45. The boss 45 is secured by way of a screw 46 to a presser rod 47 which is resiliently mounted in the housing 1. The tip of a sewing needle 48 points towards the foot 44 and the needle plate 14.

By turning the main shaft 2 in a clockwise direction as seen in FIG. 3,. a lifting motion is transmitted to the corrector 12 by way of the lifting eccentric 4, the sliding block 6, the carrier 7 and the carriage 11. A longitudinal mcvement in the direction of feed of the material is superimposed on this stroke movement by way of the travel eccentric 5, the connecting rod 8, the frame 36 and the carrier 7.

In place of the eccentric drive shown in the drawings, the corrector 12 may also be driven by a linkage, which is not shown in the drawings.

As the carriage 11, which carries the corrector 12, is displaceably mounted in the carriage guide 10 transversely of the direction of material feed, and is connected by way of the connecting rod 20 to the adjustable pivot point 29, it performs a transverse movement from a position close to the pivot point to a position distant from the pivot point when the pivot point 29 is in a first end position shown in FIG. 2. When the pivot point 29 is in a middle position (not shown), that is central with respect to the carriage 11, the corrector 12 performs only a minimum transverse movement which corresponds approximately to the height of arc of a circular arc of the connecting rod about the pivot point 29, that is, the transverse movement of the corrector is virtually ineffective as an alignment movement transversely of the direction of material feed. When the pivot point 29 is in a second end position (not shown), which is a mirror image of the first end position, the carriage 11 performs a transverse movement from a position remote from the pivot point to a position close to the pivot point.

As a result, the size and direction of the transverse movement of the corrector 12 can be controlled and the workpiece can be aligned immediately in advance of the stitch formation point.

The foregoing detailed description is given for clearness of understanding only, and no unnecessary limitations should be understood therefrom, as modifications will be obvious to those skilled in the art.

What is claimed is:

1. A workpiece controlling device for a sewing machine having a workpiece feed mechanism which feeds material in a substantially straight line, in which an alignment means of an alignment member can be moved transversely relative to the direction of material feed in the sewing machine for automatic, controlled alignment of workpieces with the point of stitch formation, the alignment means of the alignment member is disposed immediately in advance of the point of stitch formation in the region of a needle plate and acts on the workpiece in synchronism with the stitch formation, and a control command device controls the transverse motion of the alignment means, in which the alignment means of the alignment member is a corrector which is driven in the same direction of feed as the feed mechanism.

2. A workpiece controlling device as claimed in claim 1, in which the corrector is movable in a direction which is inclined relative to the direction of material feed and which results from the movement transverse to and movement in the direction of material feed.

3. A workpiece controlling device as claimed in claim 1, in which the alignment member is disposed beneath the sewing machine needle plate and the alignment means is a corrector which projects through the sewing machine needle plate and is moved up and down against a resilient workpiece holding-down device in synchronism with stitch formation.

4. A workpiece controlling device as claimed in claim 1, in which the alignment means is a corrector disposed opposite a workpiece holding-down device which is moved up and down in synchronism with stitch formation.

5. A workpiece controlling device as claimed in claim 1, in which the transverse and longitudinal movements of the corrector can be altered independently of one another by adjusting means in the drive mechanism therefor.

6. A workpiece controlling device as claimed in claim 1, in which the corrector is secured to an alignment member carrier which is connected to the main shaft of the sewing machine by a transmission which is adapted to move the corrector in the material feed direction.

7. A workpiece controlling device as claimed in claim 6, in which there is disposed in the transmission for driving the corrector in the material feed direction an intermediate element which derives a superimposed transverse movement of the corrector from the longitudinal movement of the corrector.

8. A workpiece controlling device as claimed in claim 6, in which the alignment member carrier has a carriage guide and the corrector is secured to a carriage.

9. A workpiece controlling device as claimed in claim 8, in which the carriage is connected to an adjustable pivot point by a connecting rod.

10. A workpiece controlling device as claimed in claim 9, including an adjusting device for moving the adjustable pivot point for one end of the connecting rod from a first end position through a middle position to a second end position.

11. A workpiece controlling device for a sewing machine, comprising:

a workpiece feed mechanism which feeds material in a substantially straight line;

alignment means disposed immediately in advance of the point of stitch formation in the region of a needle plate;

means for moving the alignment means transversely relative to the direction of material feed in the sewing machine, with the alignment means acting on the workpiece in synchronism with the stitch formation; and means for controlling the transverse motion of the alignment means, wherein the alignment means comprises a corrector, and including means for driving the corrector in the same direction of feed as the feed mechanism.

12. The controlling device of claim 11 wherein the moving means and driving means move the corrector in a direction inclined relative to the direction of material feed.

13. The controlling device of claim 11 wherein the alignment means comprises a corrector which projects through the needle plate, and including means for moving the corrector up and down against a resilient workpiece holding-down device in synchronism with stitch formation.

14. The controlling device of claim 11 wherein the alignment means comprises a corrector disposed opposite a workpiece holding-down device, and including means for moving the corrector up and down in synchronism with stitch formation

15. The controlling device of claim 11 including means for independently altering transverse and longitudinal movement of the corrector.

16. The controlling device of claim 11 wherein the corrector is secured to an alignment member carrier, said carrier being connected to a main shaft of the sewing machine by a transmission which is adapted to move the corrector in the material feed direction.

17. The controlling device of claim 16 wherein the transmission has an intermediate element which derives a superimposed transverse movement of the corrector from the longitudinal movement of the corrector.

18. The controlling device of claim 16, wherein the alingment member carrier has a carrier guide, and in which the corrector is secured to a carriage.

19. The controlling device of claim 18, wherein the carriage is connected to an adjustable pivot point by a connecting rod.

20. The controlling device of claim 19, including an adjusting device for moving the pivot point from a first end position through a middle position to a second end position.

21. A workpiece controlling device for a sewing machine having a workpiece feed mechanism which feeds material in a substantially straight line, in which an alignment means of an alignment member can be moved transversely relative to the direction of material feed in the sewing machine for automatic, controlled alignment of workpieces with the point of stitch formation, the alignment means of the alignment member is disposed immediately in advance of the point of stitch formation in the region of a needle plate and acts on the workpiece in synchronism with the stitch formation, and a control command device controls the transverse motion of the alignment means, in which the alignment member is disposed beneath the sewing machine needle plate and the alignment means is a corrector which projects through the sewing machine needle plate and is moved up and down against a resilient workpiece holding-down device in synchronism with stitch formation.

22. A workpiece controlling device for a sewing machine having a workpiece feed mechanism which feeds material in a substantially straight line, in which an alignment means of an alignment member can be moved transversely relative to the direction of materia feed in the sewing machine for automatic, controlled alignment of workpieces with the point of stitch formation, the alignment means of the alignment member is disposed immediately in advance of the point of stitch formation in the region of a needle plate and acts on the workpiece in synchronism with the stitch formation, and a control command device controls the transverse motion of the aligment means, in which the alignment means is a corrector disposed opposite a workpiece holding-down device which is moved up and down in synchronism with stitch formation.

23. A workpiece controlling device for a sewing machine, comprising:

a workpiece feed mechanism which feeds material in a substantially straight line;

alignment means disposed immediately in advance of the point of stitch formation in tthe region of a needle plate;

means for moving the alignment means transversely relative to the direction of material feed in the sewing machine, with the alignment means acting on the workpiece in synchronism with the stitch formation; and means for controlling the transverse motion of the alignment means, wherein the alignment means comprises a corrector which projects through the needle plate, and including means for moving the corrector up and down against a resilient workpiece holding-down device in synchronism with stitch formation.

24. A workpiece controlling device for a sewing machine, comprising;

a workpiece feed mechanism which feeds material in a substantially straight line;

alignment means disposed immediately in advance of the point of stitch formation in the region of a needle plate;

means for moving the alignment means transversely relative to the direction of material feed in the sewing machine, with the alignment means acting on the workpiece in synchronism with the stitch formation; and means for controlling the transverse motion of the alignment means, wherein the alignment means comprises a corrector disposed opposite a workpiece holding-down device, and including means for moving the corrector up and down in synchronism with stitch formation.

* * * * *